US007492322B2

(12) United States Patent
Jung et al.

(10) Patent No.: US 7,492,322 B2
(45) Date of Patent: Feb. 17, 2009

(54) MULTI-SATELLITE ACCESS ANTENNA SYSTEM

(75) Inventors: Young-Bae Jung, Daejon (KR); Soon-Ik Jeon, Daejon (KR); Chang-Joo Kim, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 64 days.

(21) Appl. No.: 11/298,000

(22) Filed: Dec. 8, 2005

(65) Prior Publication Data

US 2006/0132372 A1 Jun. 22, 2006

(30) Foreign Application Priority Data

Dec. 21, 2004 (KR) ..... 10-2004-0109398

(51) Int. Cl.
*H01Q 3/00* (2006.01)
*H01Q 3/02* (2006.01)

(52) U.S. Cl. ..... 343/757; 343/766; 343/882

(58) Field of Classification Search ..... 343/757, 343/766, 882, 758, 761, 763, 878, 879, 880; 342/359

See application file for complete search history.

(56) References Cited

U.S. PATENT DOCUMENTS

| | | | | |
|---|---|---|---|---|
| 5,717,407 | A * | 2/1998 | Hong | 343/700 MS |
| 6,204,823 | B1 | 3/2001 | Spano et al. | |
| 6,999,036 | B2 * | 2/2006 | Stoyanov et al. | 343/765 |
| 7,015,866 | B1 * | 3/2006 | Lopez | 343/757 |
| 2002/0196193 | A1 * | 12/2002 | Butler et al. | 343/766 |

OTHER PUBLICATIONS

Jiro Hirokawa et al, "A Two-Beam Slotted Leaky Waveguide Array for Mobile Reception of Dual Polarization DBS," IEEE Trans. Vehicular Technology, vol. 48, No. 1, pp. 1-7, 1999.

* cited by examiner

*Primary Examiner*—Hoang V Nguyen
*Assistant Examiner*—Robert Karacsony
(74) *Attorney, Agent, or Firm*—Ladas & Parry LLP

(57) ABSTRACT

A multi-satellite access antenna system is disclosed. The multi-satellite access antenna system includes: a subarray antenna having two types of radiation means having different electric characteristics arranged on both sides of the subarray antenna and an active module interposed between the radiation means for amplifying a signal inputted at the radiation means and controlling a phase.

8 Claims, 9 Drawing Sheets

MULTI-SATELLITE ACCESS ANTENNA SYSTEM

FIELD OF THE INVENTION

The present invention relates to a multi-satellite access antenna system; and, more particularly, to an active phase array antenna system having two types of subarray antennas to access a plurality of satellites having different polarization characteristics.

DESCRIPTION OF RELATED ARTS

In order to access a plurality of satellites in a conventional multi-satellite antenna system, antenna elements of a subarray antenna are designed to receive two polarized waves. The conventional multi-satellite antenna system selects one of the antenna elements according to specifications of a target satellite to access the target satellite.

FIG. 1 is a block diagram showing a conventional multi-satellite access antenna system.

As shown in FIG. 1, the conventional multi-satellite access antenna system includes antenna elements of waveguide slot shape. That is, the antenna elements are designed as a slot of 'X' shape. Accordingly, the conventional multi-satellite access antenna system can receive a left handed circular polarization (LHCP) and a right handed circular polarization (RHCP) according to a feeding line direction of a slot antenna.

Although such a conventional multi-satellite access antenna system can access both of satellites using the LHCP and the RHCP, the conventional multi-satellite access antenna cannot access currently used four polarizations including the left handed circular polarization, the right handed circular polarization, a vertical polarization and a horizontal polarization because the number of polarizations received in one antenna system is limited to 2.

Furthermore, the conventional multi-satellite access antenna system mechanically controls only one subarray antenna in a directions of a elevation angle using a motor. Therefore, such a conventional multi-satellite access antenna system cannot be used in an antenna system requiring a large gain.

SUMMARY OF THE INVENTION

It is, therefore, an object of the present invention to provide a multi-satellite access antenna system for accessing a plurality of satellites by arranging two types of antennas having different electrical characteristics at both sides of each subarray antenna to transmit and receive a plurality of satellite signals having different polarization characteristics in an active phase array antenna system having a plurality of the subarrays, and by mechanically controlling the subarray antenna in a direction of a elevation angle to select one of antenna elements according to an electric specification of a target satellite in order to properly use the two types of antennas disposed at both sides of the subarray antenna.

In accordance with an aspect of the present invention, there is also provided a multi-satellite access antenna system for accessing a plurality of satellites having different polarization characteristics, including: a subarray antenna having two types of radiation units having different electric characteristics arranged on both sides of the subarray antenna. Also, the subarray antenna includes an active module interposed between the radiation means for amplifying a signal inputted at the radiation means and controlling a phase.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a multi-satellite access antenna system will be described in more detail with reference to the accompanying drawings.

Figure 1:
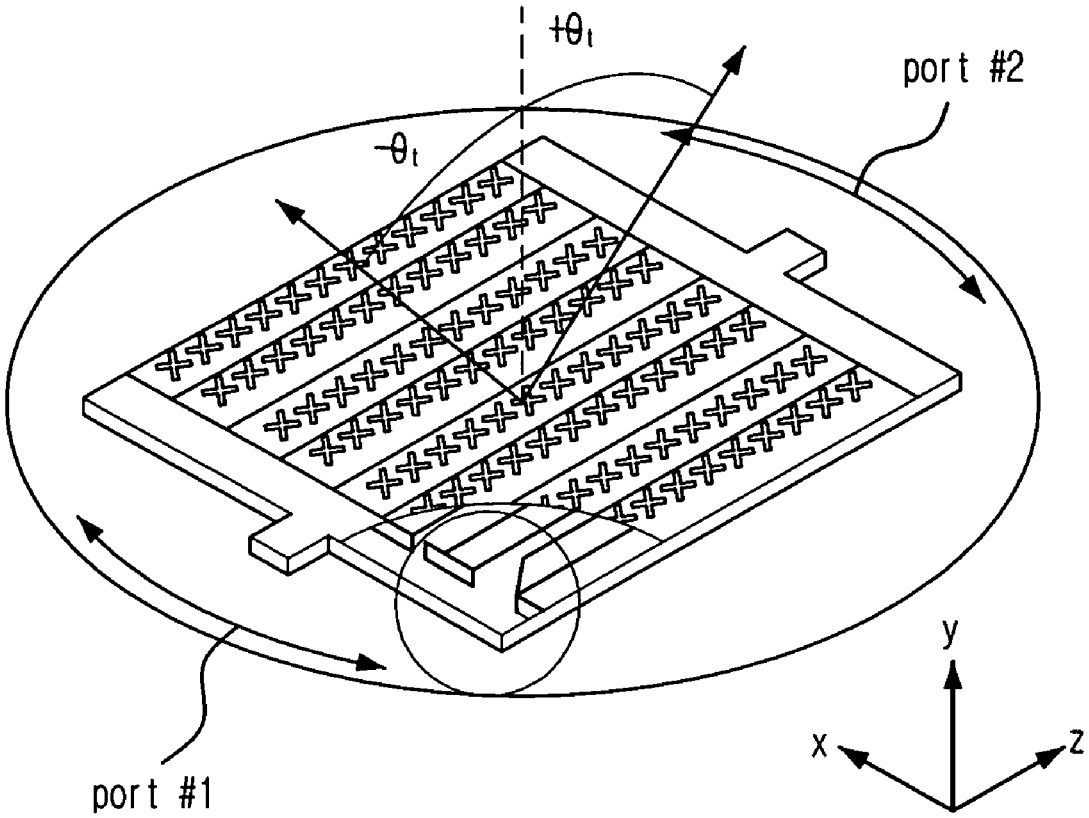
FIG. 1 is a block diagram showing a conventional multi-satellite access antenna system.
Figure 2:
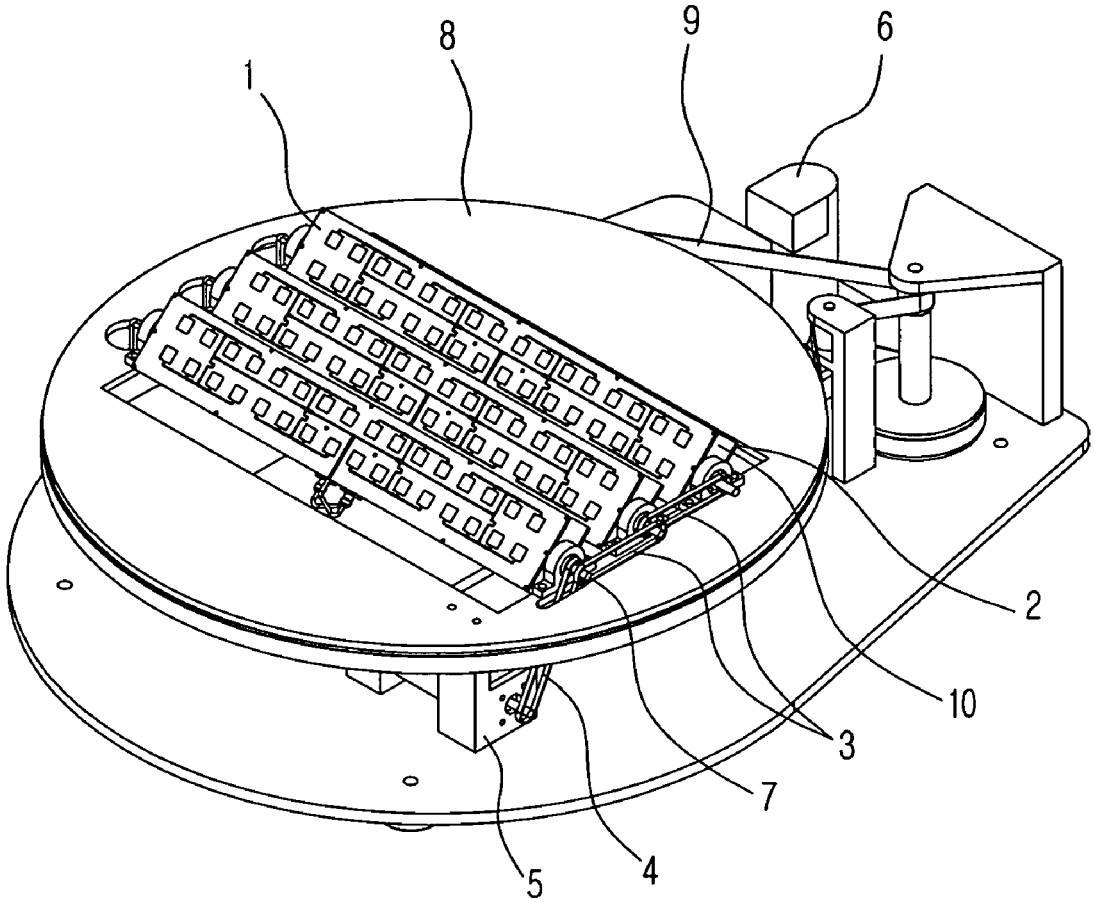
FIG. 2 is a block diagram illustrating a multi-satellite access antenna system in accordance with a preferred embodiment of the present invention.

FIG. 2 is a block diagram illustrating a multi-satellite access antenna system in accordance with a preferred embodiment of the present invention.

As shown in FIG. 2, the multi-satellite access antenna system includes a plurality of subarray antennas. Each of the subarray antennas has two types of antennas 1, 2 having different electric characteristics at both sides of the subarray antenna, respectively.

In the multi-satellite access antenna system according to the present invention, an array antenna 1 configured of circular polarization radiation patches is disposed on a front side of the subarray antenna and an array antenna 2 configured of vertical polarization radiation patches is arranged on a rear side of the subarray antenna. However, the present invention is not limited by such a configuration. It is obvious to those skilled in the art that the multi-satellite access antenna system can be embodied with other antenna designs having shapes and polarization characteristics different from those shown in FIG. 2.

An active module 10 is interposed between the two types of the antennas 1 and 2 which are arranged on both sides of the subarray antenna. The active module 10 amplifies a satellite signal and controls a phase of a satellite signal received at the antennas 1 and 2. That is, the active module 10 corrects a phase difference of a satellite signal caused by mechanically controlling the plurality of subarray antennas in an elevation angle direction.

Since the active module 10 corrects the phase of the received satellite signal, the multi-satellite access antenna system according to the present invention can electrically track a target satellite as well as mechanically tracking the target satellite.

A rotation axis of the subarray antenna is disposed at a center of the subarray antenna to rotate the subarray antenna in a direction of an elevation angle in the multi-satellite access antenna system according to the present invention. Therefore, the subarray antennas are not much projected from a circular rotation plate 8. That is, a height of the subarray antenna, which is exposed over a circular rotation plate 8, is comparatively short. Therefore, the height of the multi-satellite access antenna system is comparatively short. That is, the multi-satellite access antenna system according to the present invention has advantageous structure.

Figure 4:
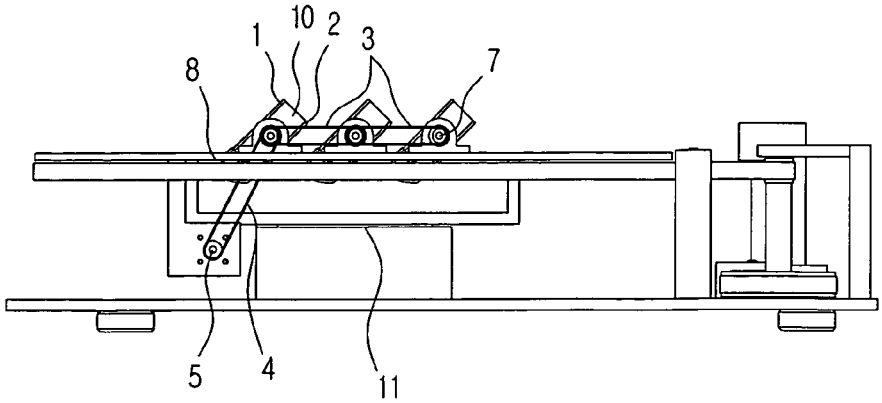
FIG. 4 is a side elevation view of the multi-satellite access antenna system shown in FIG. 2.

FIG. 4 shows a detailed structure of the sub-antenna having the active module.

The multi-satellite access antenna system mechanically controls the subarray antennas to select one of the antennas 1 and 2 arranged on the both sides of each subarray antenna in order to receive or transmit satellite signals from a target satellite.

In order to mechanically control the subarray antennas in the present invention, the multi-satellite access antenna system includes a common belt 3, an elevation angle control belt 4 and an elevation angle control motor 5. The common belt 3 is disposed at one axis 7 of each subarray antenna in order to mechanically control the plurality of subarray antennas at the same time. The elevation angle control belt 4 is connected to the elevation angle control motor 5 and disposed at one of the subarray antenna.

The rotation force of the wave-angel control motor 5 is transferred to the elevation angle control belt 4 to rotate the connected one of the subarray antennas. Accordingly, the plurality of sub-antennas is simultaneously rotated by the common belt 3 in a same elevation angle direction.

As described above, the subarray antennas are mechanically controlled in the elevation angle direction using the belts in the present embodiment. However, the present invention is not limited thereby. Other mechanical method of controlling an elevation angle of subarray antennas may be used.

In order to smoothly track a target satellite in the antenna system, it also requires controlling of the subarray antenna in a direction of an azimuth angle as well as controlling of the subarray antenna in a direction of an elevation angle. In order to trace a satellite in a direction of the azimuth angle in the present invention, the multi-satellite access antenna system includes a circular rotating plate 8 having a plurality of subarray antennas, a rotating belt 9 disposed at a circumference of the circular rotating plate 8, and an azimuth angle control motor 6. That is, the driving force of the azimuth angle control motor 6 rotates the rotating belt 9 and accordingly, the circular rotating plate 8 is rotated with the subarray antennas by the rotating belt 9.

Figure 3:
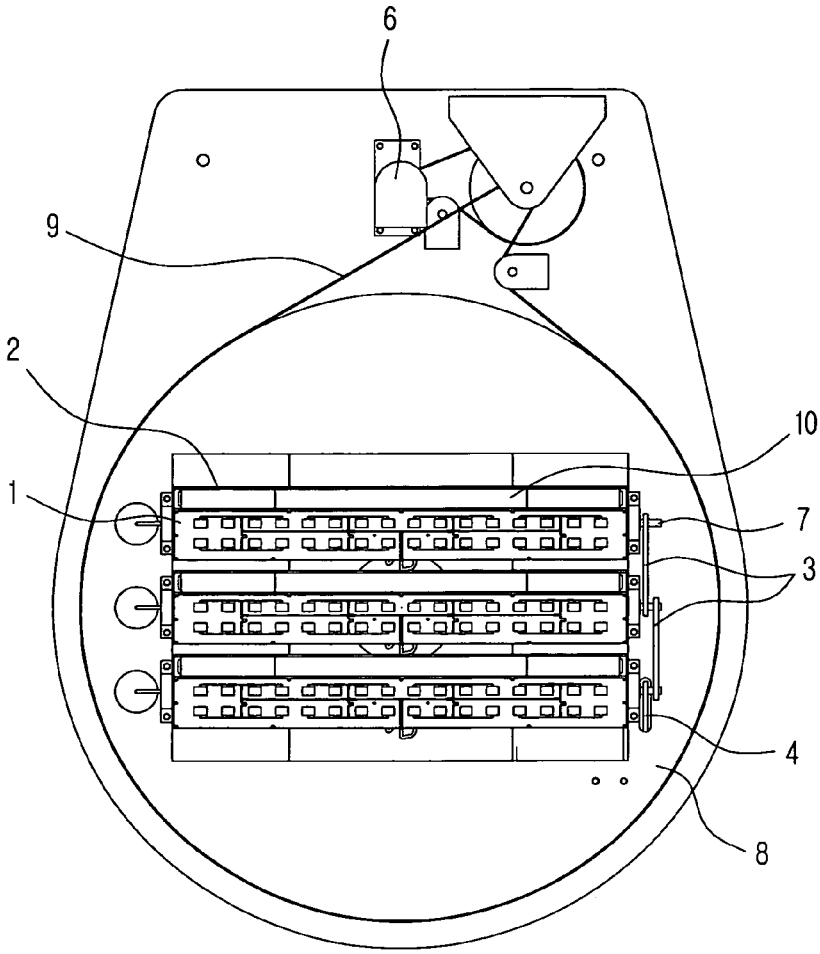
FIG. 3 is a top view of the multi-satellite access antenna system shown in FIG. 2.

FIG. 3 is a top view of FIG. 2, and FIG. 4 is a side elevation view of FIG. 2 for describing the structure of the multi-satellite access antenna system in detail.

FIGS. 3 and 4 show structural characteristics of the multi-satellite access antenna system for mechanical controlling of the plurality of subarray antennas in the elevation angle direction.

In order to effectively transfer the driving force of the wave angel control motor 5, the plurality of subarray antennas is connected to the common belt 3 and the elevation angle control belt 4.

The multi-satellite access antenna system also includes the azimuth angle control motor 6 to mechanically control the subarray antenna in the azimuth angle direction. The azimuth angle control motor 6 is connected to the circular rotating plate 8 through the rotating belt 9. A rotating axis structure 11 including a rotary joint is disposed at the center of the circular rotating plate 8 as a path of electric power and a satellite signals to the antennas on the circular rotating plate 8 and the active module.

Figure 5A:
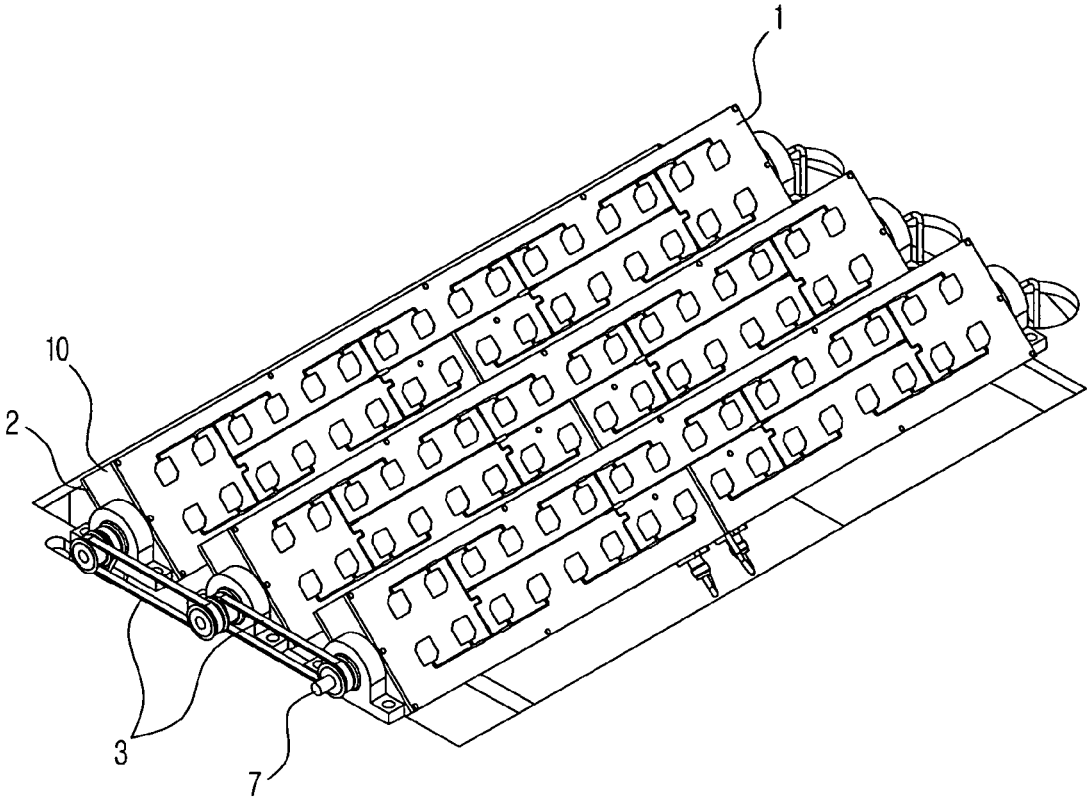
FIGS. 5A and 5B shows subarray antenna of the multi-satellite access antenna system shown FIG. 2.
Figure 5B:
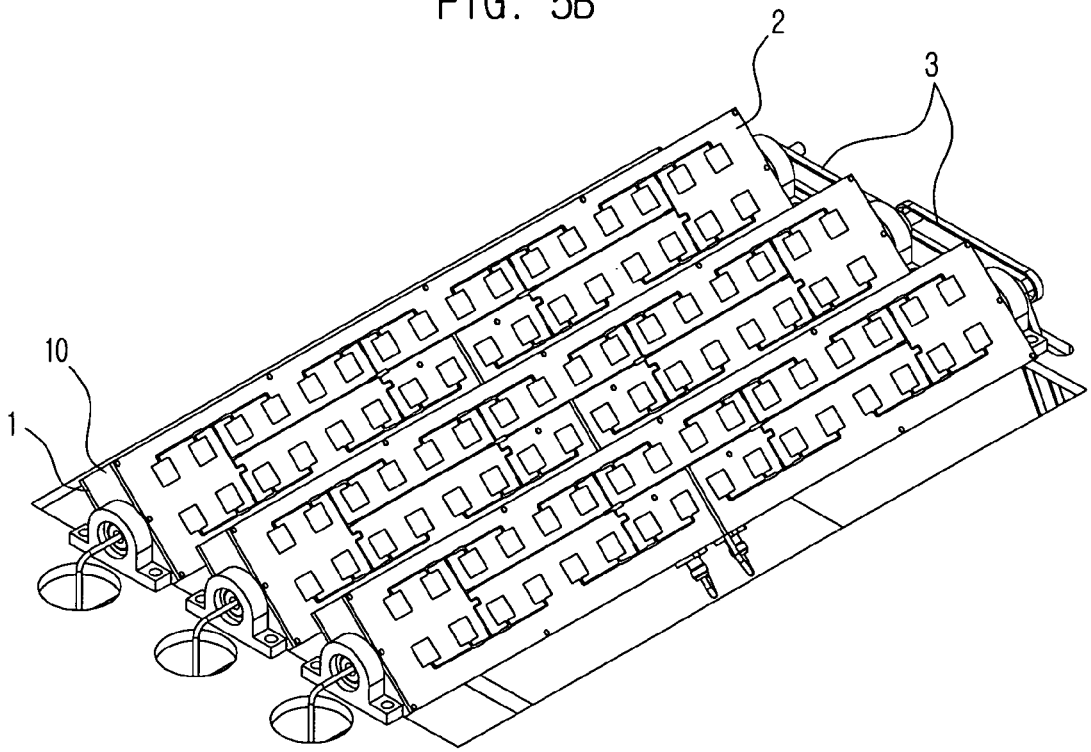

FIGS. 5A and 5B show the subarray antenna of FIG. 2.

FIGS. 5A and 5B are magnified views of the subarray antenna shown in FIG. 2.

As shown in FIG. 5A, the array antenna 1 using circular polarization radiation patches is disposed on a front surface of the subarray antenna. The array antenna 2 using vertical polarization radiation patches is disposed on the rear surface of the subarray antenna as shown in FIG. 5B.

Figure 6A:
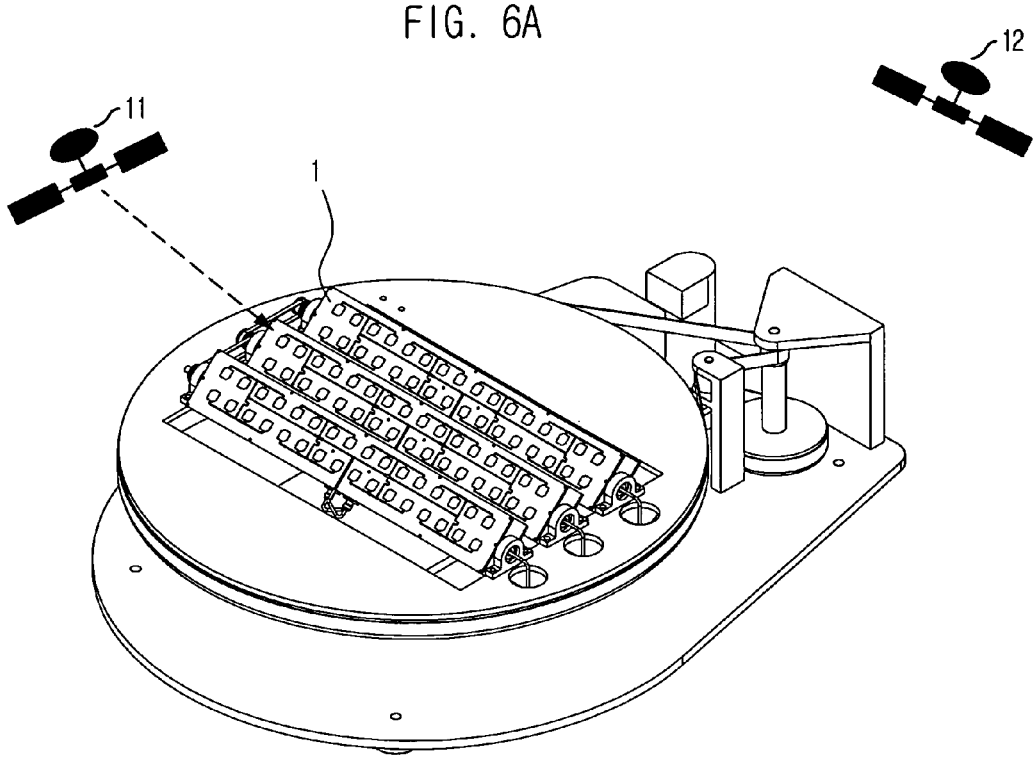
FIGS. 6A to 6C are views explaining operations of the multi-satellite access antenna system shown in FIG. 2.
Figure 6B:
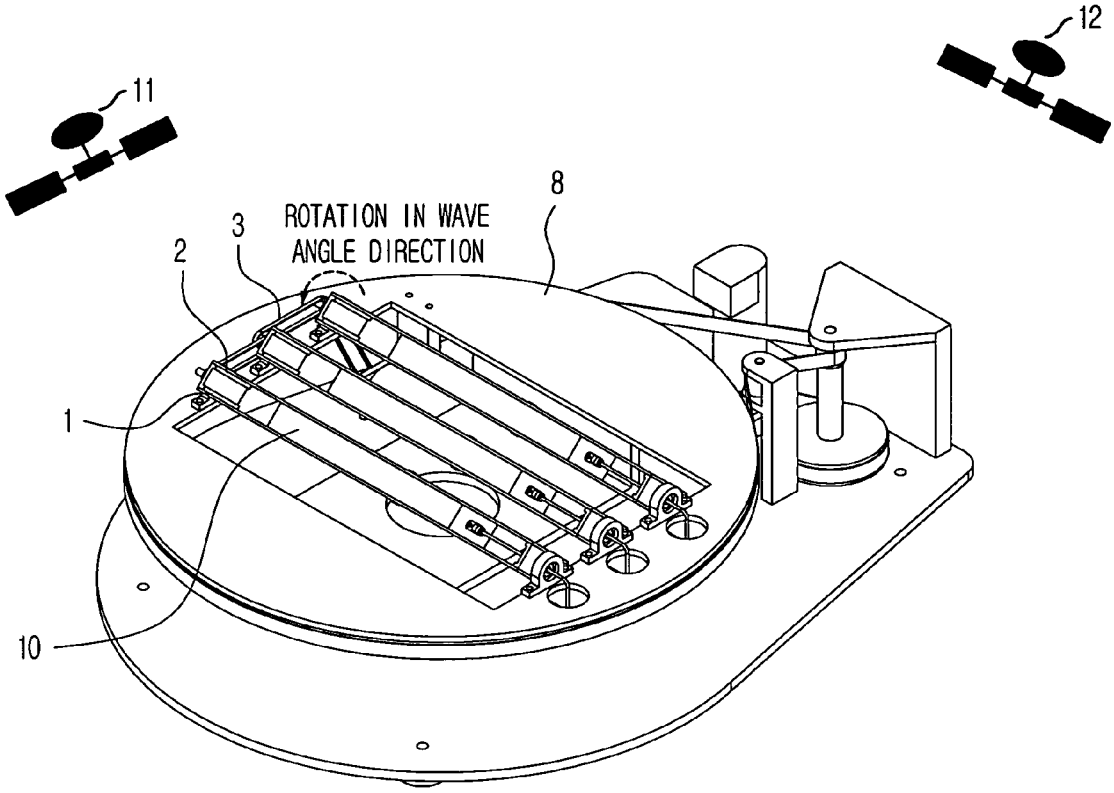
Figure 6C:
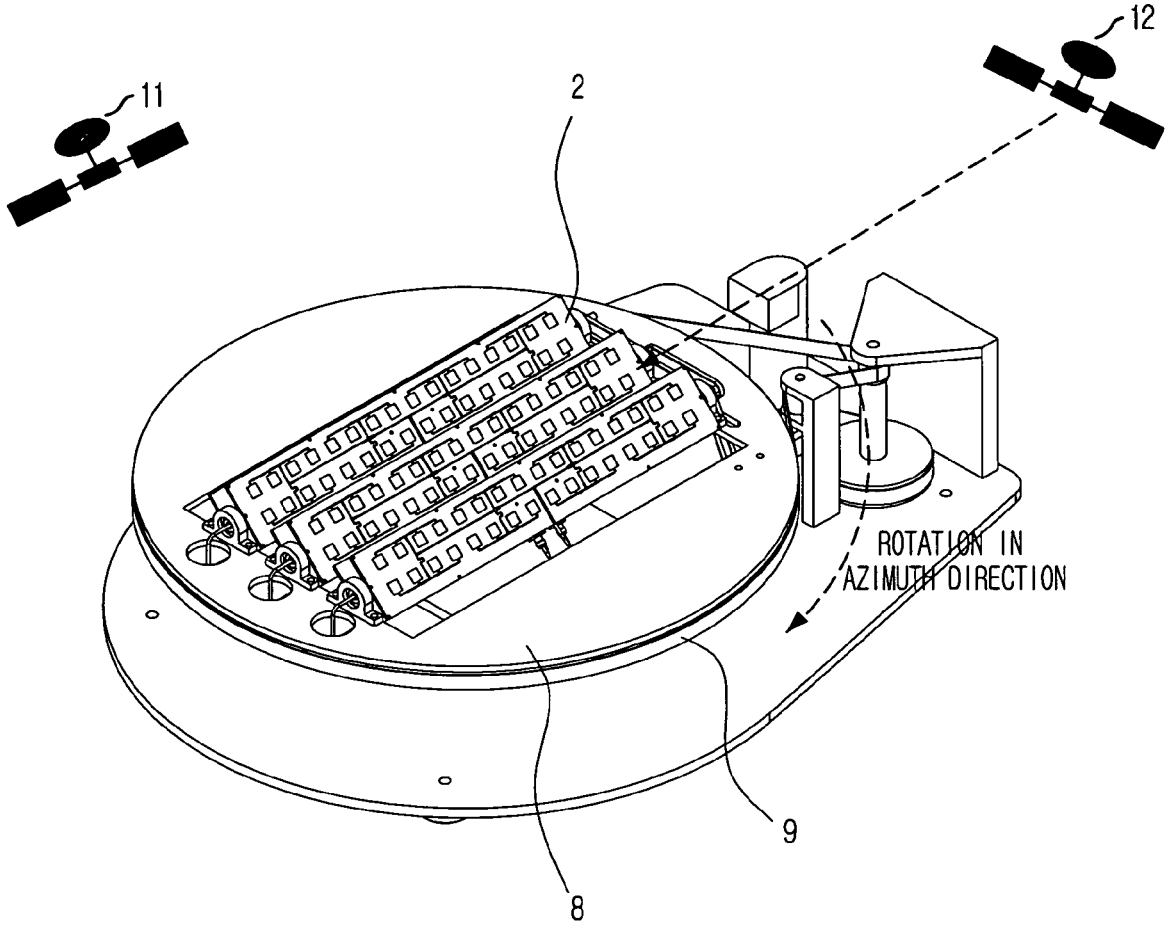

FIGS. 6A to 6C views for explaining operations of the multi-satellite access antenna system shown in FIG. 2.

An operation of accessing other satellite having different electrical specifications while the multi-satellite access antenna system accesses a predetermined satellite according to the present invention will be explained with reference to FIGS. 6A and 6B.

As shown in FIG. 6A, the multi-satellite access antenna system according to the present invention accesses to the predetermined satellite 11 having circular polarization characteristics. Herein, the multi-satellite access antenna system uses the array antenna 11 configured of circular polarization radiation patches disposed on the front surface of the subarray antenna.

FIG. 6B shows that the subarray antenna of the multi-satellite access antenna system is mechanically controlled in a direction of an elevation angle to access other satellite 12 having vertical polarization characteristics. That is, the antenna system uses the array antenna 2 configured of vertical polarization radiation patches disposed at the rear surface of the subarray antenna.

FIG. 6C shows that the multi-satellite access antenna system accesses to other satellite 12 having the vertical polarization characteristics by controlling the multi-satellite access antenna system in a direction of an azimuth angle.

As described above, the multi-satellite access antenna system according to the present invention uses two types of antennas disposed at the both surfaces of the subarray antenna to access a plurality of satellite.

Figure 7A:
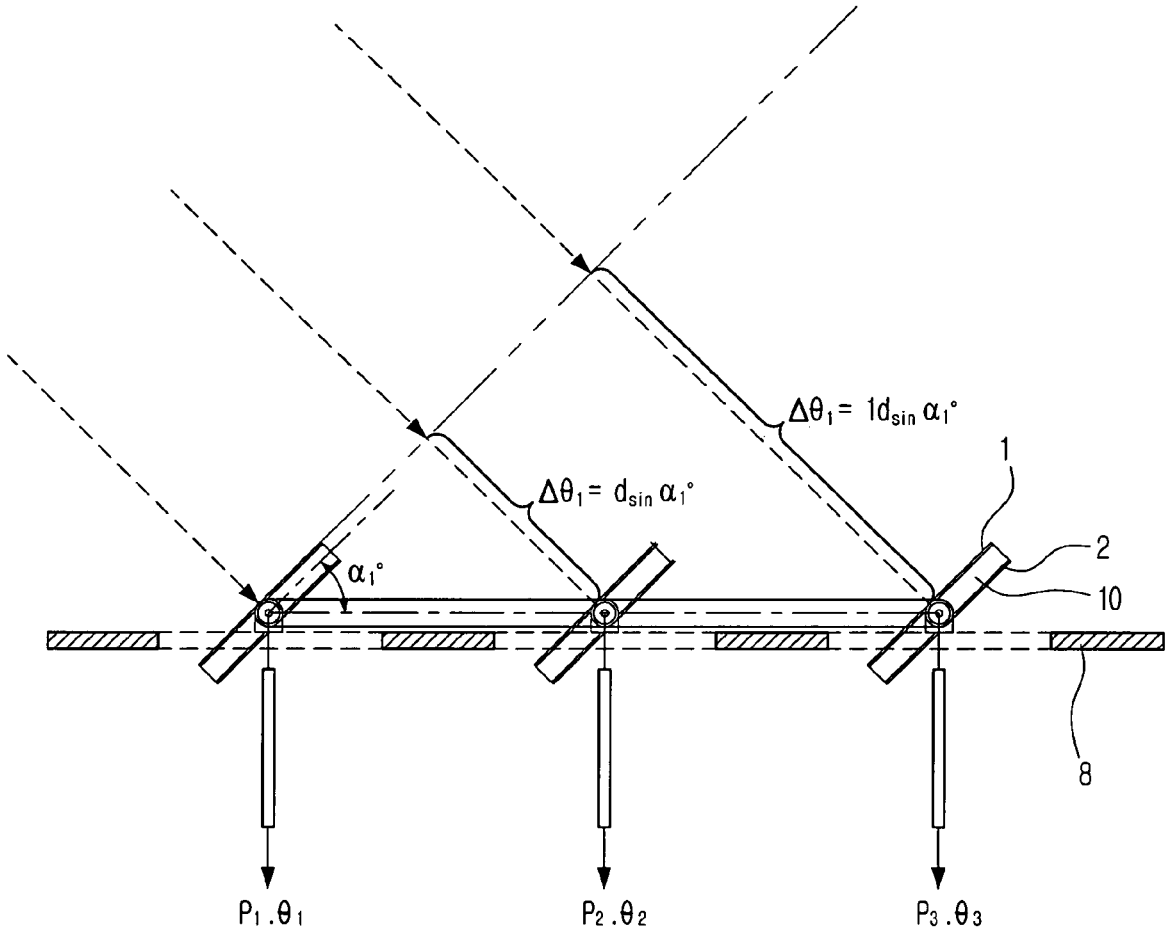
FIGS. 7A and 7B are views for describing an operation for correcting a phase of a satellite signal by mechanically controlling an elevation angle of a subarray antenna in the multi-satellite access antenna system.
Figure 7B:
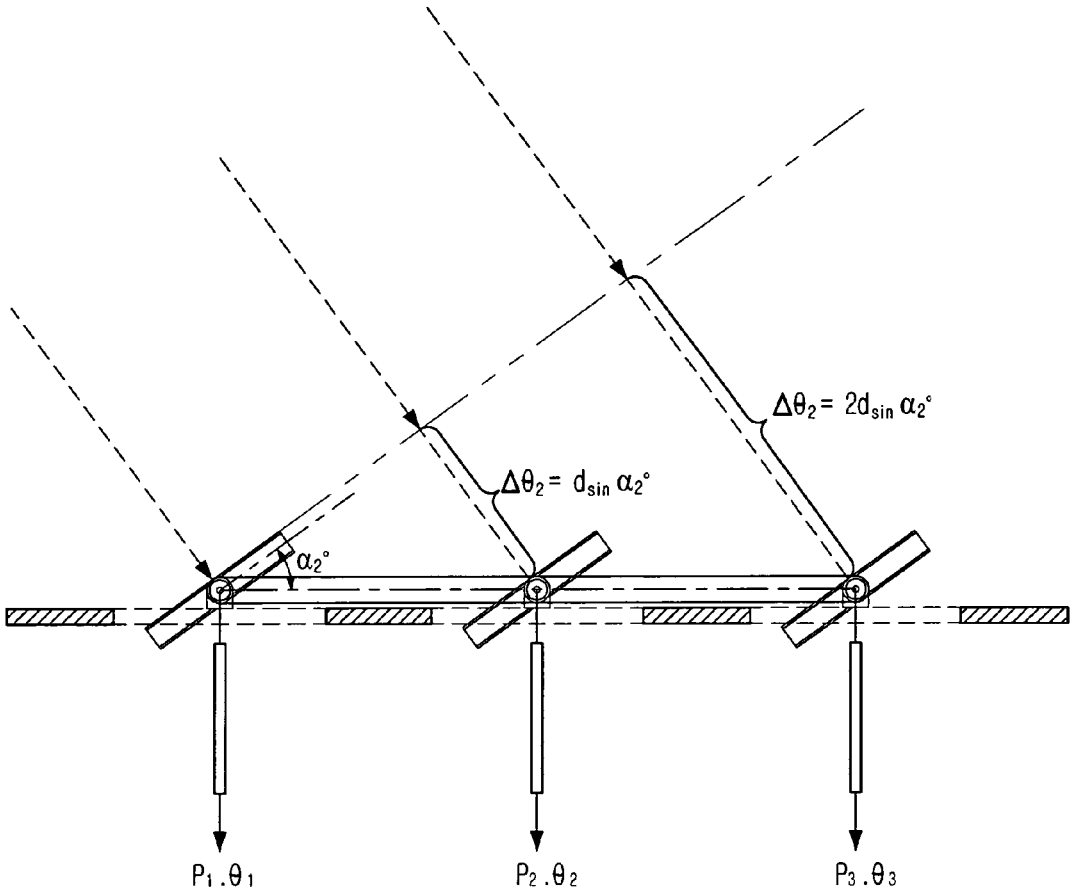

FIGS. 7A and 7B shows the multi-satellite access antenna system shown in FIG. 2 for describing an operation of correcting a phase difference of a satellite signal caused by mechanically controlling the subarray antenna in a direction of an elevation angle.

When the subarray antenna is mechanically controlled in a direction of an elevation angle, a phase difference is generated between at satellite signals inputted to a plurality of subarray antennas. Because of such a phase difference, the maximum transmitting and receiving performance cannot be achieved. Therefore, FIGS. 7A and 7B shows a method of correcting the phase difference according to the present invention.

Hereinafter, the operation of correcting the phase difference will be described using a broadcasting receiving function limited to a receiving performance as an example.

FIG. 7A shows the multi-satellite access antenna system connected to a predetermined satellite. As shown, the subarray antenna is located in the elevation angle direction of 45 degree.

If satellite signals having phases $\theta_1$, $\theta_2$, $\theta_3$ are inputted to each of the subarray antennas, a satellite signal inputted to each of adjacent subarray antennas has a phase difference as much as $\Delta\theta_1$.

Therefore, phases of satellite signals inputted to the plurality of subarray antennas must be corrected to be identical in order to provide the maximum receiving performance of the multi-satellite access antenna system. That is, the phases must have relations shown in following Eq. 1.

$$\theta_1+2\Delta\theta_1=\theta_2+\Delta\theta_1=\theta_3 \quad \text{Eq. 1}$$

Accordingly, each of the active modules connected to corresponding subarray antenna corrects the phase differences as much as $3\Delta\theta_1$, $2\Delta\theta_1$, and $\Delta\theta_1$.

FIG. 7B shows that the subarray antenna of the antenna system is mechanically controlled in an elevation angle direction of 30 degree.

As shown in FIG. 7B, if phases $\theta'_1$, $\theta'_2$, $\theta'_3$ of satellite signals are inputted to each of the subarray antennas, a satellite signal inputted to each of adjacent subarray antennas has a phase difference as much as $\Delta\theta_L$.

Therefore, the phases must be corrected to have relations shown in following Eq. 2 to provide the maximum receiving performance of the multi-satellite access antenna system.

$$\theta'_1+2\Delta\theta_1=\theta'_2+\Delta\theta_1=\theta'_3 \quad \text{Eq. 2}$$

As described above, the mechanical controlling of the subarray antenna in the elevation angle direction cause the phase difference of the satellite signal. Therefore, the multi-satellite access antenna system according to the present invention performs the phase difference correcting operation using the active module to correct the phase differences.

The multi-satellite access antenna system according to the present invention includes two types of antennas disposed at both surfaces of the subarray antenna in order to access a plurality of satellites having different polarization characteristics.

Also, the multi-satellite antenna system according to the present invention mechanically controls the subarray antenna in the elevation angle direction and the azimuth angle direction in order to trace a plurality of satellites selectively using two types of antennas disposed at the both of the subarray antenna.

Furthermore, the multi-satellite antenna system according to the present invention further includes the active module connected to each of the subarray antennas to correct the phase difference of satellite signal generated by the mechanical controlling of the subarray antenna in the elevation angle direction. That is, the active module performs the phase difference correcting operation while the subarray antenna is mechanically controlled in the elevation angle direction for correcting the phase difference caused by the mechanical control of the subarray antenna.

According to the present invention, single antenna system capable of accessing a plurality of satellites having different polarization characteristics can be embodied in an active phase array antenna including a plurality of subarray antennas.

Also, the elevation angle rotating axis of the subarray antenna is disposed at the center of the subarray antenna in the present invention. Therefore, the height of the subarray antenna projected from the circular rotating plate is reduced. Therefore, the height of the multi-satellite access antenna system according to the present invention is comparatively short. That is, the multi-satellite access antenna system according to the present invention has advantageous structure.

Furthermore, the single antenna system can access a plurality of satellites according to the present invention. Therefore, miniaturization of multi-access antenna system can be achieved according to the present invention.

Moreover, a dimensional size and a weight of the antenna system can be minimized since the single antenna system can access a plurality of satellites according to the present invention. Therefore, the antenna system according to the present invention can be easily used in a vehicle, a ship and an air bus.

The present application contains subject matter related to Korean patent application No. KR 2004-0109398, filed in the Korean patent office on Dec. 21, 2004, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A multi-satellite access antenna system for accessing a plurality of satellites having different polarization characteristics, comprising:

a plurality of first subarray antennas disposed on a first surface of the antenna system, each first subarray antenna having circular polarization radiation means, having both left handed and right handed polarization electric characteristics relative to each other;

a plurality of second subarray antennas disposed on a second surface of the antenna system, each second subarray antenna having linear polarization radiation means having both vertical and horizontal polarization electrical characteristics relative to each other, wherein the first and second surfaces are, segregated from each other on separate opposite sides of the antenna system; and an active module interposed between the first and second subarray antennas wherein the active module is operatively configured to substantially correct a phase difference artifact of a received satellite signal brought about by an elevation angle of anyone of the subarray antennas when inputting the received satellite signal.

2. The multi-sattelite access antenna system as recited in claim 1, wherein the active module amplifies the recieved sattelite signal inputted into anyone of the subarray antennas.

3. The multi-satellite access antenna system as recited in claim 1, wherein each radiation means is a patch radiation means.

4. The multi-satellite access antenna system as recited in claim 1, wherein all of the array antennas are controlled in a direction of an elevation angle using a mechanical controlling method.

5. The multi-satellite access antenna system as recited in claim 4, wherein all of the subarray antennas are connected through a common belt in order to simultaneously control an alighnment of all of the subarray antennas in a substantially common angle by using the mechanical controlling method.

6. The multi-satellite antenna system as recited in claim 4, wherein an elevation angle control motor and all of the first subarray antennas are connected through an elevation angle control belt in order to transfer a driving force of the elevation angel control motor to all of the subarray antennas in a substantially common angle using the mechanical controlling method.

7. The multi-satellite antenna system as recited in claim 5, wherein the antenna system includes an elevation angle direction rotating axis substantially at a center of the antenna system.

8. The multi-satellite antenna system as recited in claim 1, wherein the subarray antenna system substantially corrects a phase difference through a phase control function of an active module connected to each of the subarray antennas in order to correct the phase difference artifact of a satellite signal inputted into anyone of the subarray antennas.

* * * * *